US005959651A

United States Patent [19]

Nagahata et al.

[11] Patent Number: 5,959,651

[45] Date of Patent: Sep. 28, 1999

[54] THERMAL PRINTHEAD AND METHOD OF ADJUSTING CHARACTERISTIC THEREOF

[75] Inventors: Takaya Nagahata; Koji Nishi, both of Kyoto, Japan

[73] Assignee: Rohm Co., Ltd., Kyoto, Japan

[21] Appl. No.: 08/875,255

[22] PCT Filed: Nov. 29, 1996

[86] PCT No.: PCT/JP96/03518

§ 371 Date: Jul. 22, 1997

§ 102(e) Date: Jul. 22, 1997

[87] PCT Pub. No.: WO97/21546

PCT Pub. Date: Jun. 19, 1997

[30] Foreign Application Priority Data

Aug. 12, 1995 [JP] Japan ..... 7-320056

[51] Int. Cl.[6] ..... B41J 2/335

[52] U.S. Cl. ..... 347/200

[58] Field of Search ..... 347/200, 205, 347/209, 210

[56] References Cited

U.S. PATENT DOCUMENTS 5,335,002 8/1994 Nagahata et al. ..... 347/209

FOREIGN PATENT DOCUMENTS 1-86546 6/1989 Japan .

1-127749 8/1989 Japan .

*Primary Examiner*—Huan Tran

*Attorney, Agent, or Firm*—Merchant & Gould, P.C.

[57] ABSTRACT

A thermal printhead is provided which includes a head substrate (11) made of an insulating material, a heating element (12) arranged along an edge of the substrate, drive ICs (13) for driving the heating element, a temperature sensor (18) mounted on the head substrate for temperature monitoring of the heating element, and a heat sink (20) attached to the head substrate. The heat sink has a first surface for attachment to the head substrate and a second surface corresponding in location to the temperature sensor. The second surface faces the head substrate but is spaced therefrom to define a heat-transfer adjusting region (22). The head substrate and the heat sink are attached together by an adhesive member having a desired heat conductivity.

14 Claims, 7 Drawing Sheets

THERMAL PRINTHEAD AND METHOD OF ADJUSTING CHARACTERISTIC THEREOF

TECHNICAL FIELD

The present invention relates to a thermal printhead to print on printing paper by thermal recording or by thermal transfer recording, and to a method of adjusting a characteristic of the printhead.

BACKGROUND ART

The arrangement of a typical prior art thermal printhead 10 is shown in FIGS. 8–11. Reference numeral 11 indicates a head substrate. The substrate, which is made of an insulating material such as alumina-ceramic, has an upper surface provided with a heating element 12 and a plurality of drive ICs 13 for driving the heating element 12. When the thermal printhead is a thick film-type, the heating element 12 is made by a thick film printing method and configured into a narrow strip extending along a side edge of the substrate. FIG. 11 shows a common electrode 14 having comb-like teeth 14*a* extending under the heating element 12 and individual electrodes 15 arranged like comb-like teeth. Each individual electrode 15 extends toward the other side edge of the head substrate to be wire-bonded to an output pad of a drive IC 13. Each drive IC 13 includes power pads and signal pads which are wire-bonded to a predetermined wiring pattern formed on the substrate.

When a selected individual electrode 15 is turned on by a corresponding drive IC 13, an electric current is passed across a portion (shaded in FIG. 11) defined by a pair of comb-like teeth 14*a* of the common electrode 14 which sandwich the selected individual electrode therebetween, and heat is generated at the portion. In this way, the respective portions defined between the comb-like teeth 14*a* of the common electrode 14 function as heating dots 17. Each of the comb-like teeth 14*a* of the common electrode 14 is rendered to have a very small width. The teeth are spaced from each other by 125 $\mu$m when a desired printing density is 200 dpi for example. This also applies to the individual electrodes 15. The minute wiring patterns including the common electrode and individual electrodes are formed by etching a conductive layer made of e.g. gold applied over the substrate.

To produce a thermal printhead having the above-mentioned printing density of 200 dpi and capable of printing on A4-size printing paper, 1728 heating dots 17 are arranged in line on the head substrate. When the drive IC 13 has 64-bit output pads, 27 drive ICs are mounted on the head substrate. The head substrate 11 is also provided with a thermistor 18 as a temperature sensor for monitoring the temperature of the heating element 12. Generally, the thermistor 18 is disposed at a longitudinally central portion of the head substrate 11 and between two adjacent drive ICs 13 for convenience of arrangement of the wiring pattern. The drive ICs and wire-bonded portions are enclosed by a protective coating 19 made of an epoxy resin for example.

A heat sink 20 is made of a material providing good heat dissipation such as aluminum. The head substrate 11 is attached to the heat sink 20 via an acrylic resin adhesive 21 for example.

The head substrate 11 is made of a fragile insulating plate. However, the strength of the thermal printhead as a whole is properly maintained by mounting the head substrate 11 on the heat sink 20 which has great mechanical strength. Further, such an arrangement improves the printing quality, since heat generated at the heating element 12 during operation of the printhead is conducted to the heat sink.

The printing operation by the above thermal printhead is performed for each line. For this, output pads corresponding to selected bits are turned on for a predetermined time, based on the 1728-bit printing data serially input in shift registers of the drive ICs 13.

For high-speed printing, a printing period (the interval between the starting point of a printing operation and the starting point of the next printing operation) should be shortened. Also, it is necessary to control driving power supplied to the heating element 13 by monitoring the temperature of the heating element, so that so-called trailing phenomenon and fainting phenomenon are avoided. Specifically, the actuating time for heat generation (the width of a printing pulse) is adjusted within a printing period by monitoring heat generated by the heating element 12 with the use of the thermistor 18. For instance, when so-called solid printing is continuously performed, it is necessary to properly shorten the width of the printing pulse, thereby preventing the total amount of heat generated at the heating element from becoming unduly large. In this way, it is possible to avoid a trailing phenomenon at the end of the solid printing area. Conversely, at an initial stage of actuation of the thermal printhead, the width of the printing pulse is caused to increase for the purpose of supplying a large amount of driving power to the heating element. This is because the thermal printhead must start at room temperature.

Regarding the conventional thermal printhead, the heat sink 20 also extends under the location of the thermistor 18, as shown in FIG. 9. In such a case, the heat generated by the heating element 12 reaches the thermistor 18 via the head substrate 11 as a first path and via the heat sink 20 as a second path. The head substrate 11 and the heat sink 20 have different thermal conductivities and the lengths of the paths to the thermistor 18 are different. As a result, the heat detected by the thermistor 18 is a combination of heats conducted along the respective paths whose thermal conduction and conduction length are different. In general, variation of the heat conducted through the head substrate 11 made of a relatively thin alumina-ceramic plate is detected with a relatively good response. On the other hand, variation of the heat conducted via the heat sink 20, which is made of an aluminum plate having a thickness of more than a certain value, is detected with a relatively improper response. Therefore, the relation between the time and the temperature of the heat which is conducted via different paths and detected by the thermistor 18 does not necessarily reflect the temperature variation occurring at the heating element. Thus, the printing pulse control based on such detection may fail to provide an optimum control of the printing power for the heating element.

For solving the above problems, the adhesive 21 may be replaced for another one having a smaller thermal conductivity, so that a less amount of heat is conducted into the heat sink. Thus, the interference by the heat conducted via the heat sink may be reduced. However, this solution will give rise to another problem described below.

To properly control the width of a printing pulse for high-speed printing for example, the heat generated by the heating element 12 should be effectively conducted into the heat sink 20. This is because insufficient heat conduction into the heat sink 20 will cause an unduly rapid increase in temperature of the heating element 12 when, for example, plural lines are sequentially printed. To deal with this problem, the width of a printing pulse may be shortened. However, this solution will overload the control unit (CPU) performing the control. Such a situation may be properly dealt with by utilizing a control unit (CPU) which is capable of performing a remarkably high speed processing. However, the cost for it is unduly high, and therefore such a unit may not be readily adopted.

The replacement of the adhesive 21 gives rise to the problem described above. Besides, with the above replacement, the temperature detecting response of the temperature sensor can only be varied within a small range. As another way to render the temperature sensor to detect a temperature variation which reflects the temperature variation of the heating element more properly, it is possible to arrange the thermistor very close to the heating element. However, this solution necessitates modification of basic arrangements of the head substrate, and therefore is disadvantageous in terms of costs for manufacturers of thermal printheads.

DISCLOSURE OF THE INVENTION

The present invention has been proposed under these circumstances. Its object is to provide a thermal printhead and a method of adjusting a characteristic of the same, wherein the detecting response for the temperature variation of the heating element is variable within a wide range and the heat dissipation from the heat sink is variable, with minimum modification.

To achieve the above object, the present invention takes the following technical measures.

According to a first aspect of the present invention, there is provided a thermal printhead including a head substrate made of an insulating material, a heating element arranged along an edge of the substrate, drive ICs for driving the heating element, a temperature sensor mounted on the head substrate for temperature monitoring of the heating element, and a heat sink attached to the head substrate. The heat sink has a first surface for attachment to the head substrate and a second surface corresponding in location to the temperature sensor. The second surface faces the head substrate but spaced therefrom to define a heat-transfer adjusting region. The head substrate and the heat sink are attached together by an adhesive member having a desired heat conductivity.

The heat-transfer adjusting region may be provided with a heat-transfer adjusting member. In this regard, the heat-transfer adjusting region may be entirely occupied by the heat-transfer adjusting member. Alternatively, the heat-transfer adjusting member may be provided only at a portion corresponding to the location of the temperature sensor on the head substrate.

The heat-transfer adjusting region may be formed by providing the heat sink with a cutout. Typically, the heat sink is formed by extrusion using aluminum. Thus, the formation of the cutout may be performed by making relatively simple modifications to extruding molds.

The heat generated at the heating element is conducted to the temperature sensor along a path via the head substrate and a path via the heat sink. According to the present invention, the heat transfer along the heat sink path to the temperature sensor is adjusted by the heat-transfer adjusting region. For instance, when the heat-transfer adjusting region is not occupied by a heat-transfer adjusting member, that is, only the air is present there, only the heat via the head substrate is substantially conducted to the temperature sensor, since the air functions as a heat insulator. The head substrate, which is a thin plate made of alumina-ceramic for example, has a high thermal conductivity. Thus, with the heat-transfer adjusting region thermally insulated by the air as described above, it is possible for the temperature sensor to detect the temperature variation of the heating element more accurately. Conversely, when it is desired to lower the detecting response of the temperature sensor for the temperature variation of the heating element, the heat-transfer adjusting region is rendered to have an increased thermal conductivity. Then, the temperature variation of the heating element is conducted to the temperature sensor along the path via the head substrate and along the path via the heat sink with timewise dicrepancy. As a result, the detecting response of the temperature sensor for the temperature variation is lowered. As described above, according to the present invention, the detecting response of the temperature sensor for the temperature variation of the heating element is easily varied within a wide range by adjusting the thermal conductance of the heat-transfer adjusting region, and there is no need to make modifications to the basic arrangement of the head substrate, such as alteration of the location of the temperature sensor.

A heat-transfer adjusting member such as a silicone resin for example may be used to improve the thermal conductance of the heat-transfer adjusting region. In this regard, the heat-transfer adjusting member may be rendered to occupy the entirety of the heat-transfer adjusting region, or alternatively be provided only to correspond in location to the temperature sensor on the head substrate.

As described above, the detecting response of the temperature sensor for the temperature variation of the heating element is readily adjusted by providing the heat-transfer adjusting region with a necessary heat-transfer adjusting member in various manners.

Further, according to the present invention, the head substrate and the heat sink are attached together by an adhesive member having a desired heat conductivity. When an adhesive member having a low thermal conductivity is selected, the heat dissipation from the heat sink is substantially reduced. Alternatively, when an adhesive member having a high thermal conductivity is selected, the heat dissipation from the heat sink is substantially improved. Generally, when it is desired to control the width of a printing pulse during a high-speed printing operation without unduly overloading the CPU, the heat dissipation from the heat sink should be improved. To this end, an adhesive member having a high thermal conductivity is selected. Like this, for the thermal printhead according to the present invention, the heat dissipation is easily adjusted without altering the shape or size of the heat sink.

According to a preferred embodiment, the adhesive member attaching the head substrate and the heat sink may be an acrylic or epoxy resin adhesive containing particles of a material having a higher heat conductivity.

A conventional adhesive member generally used to attach the head substrate and the heat sink of such a thermal printhead is an acrylic or epoxy resin adhesive. As compared with this, the adhesive member of the preferred embodiment has a higher thermal conductivity than a simple acrylic or epoxy resin adhesive, thereby improving the heat dissipation from the heat sink. For the above-mentioned material having a higher heat conductivity, particles of silicon, alumina-ceramic or metal such as copper are selected.

According to another preferred embodiment, the adhesive member may be a silicon resin adhesive.

The silicon resin adhesive can have a higher thermal conductivity than the acrylic or epoxy resin adhesive containing silicon particles for example. Therefore, the thermal printhead in this instance is suitable for the controlling of the printing pulse for a higher-speed printing operation.

According to a second aspect of the present invention, there is provided a method of adjusting a characteristic of a thermal printhead having a head substrate made of an insulating material, a heating element arranged along an edge of the substrate, drive ICs for driving the heating element, a temperature sensor mounted on the head substrate for sensing temperatures of the heating element, and a heat sink attached to the head substrate. The method includes the steps of: adjusting heat dissipation from the heat sink by attaching the head substrate to the heat sink via an adhesive member having a desired heat conductivity; and adjusting a temperature detecting response of the temperature sensor by providing the heat sink with a heat-transfer adjusting region corresponding in location to the temperature sensor on the head substrate.

According to such a method, the temperature detecting response of the temperature sensor may be altered in various ways depending on whether or not the heat-transfer adjusting region is provided with a heat-transfer adjusting member, and if any, what kind of heat-transfer adjusting member is used. At this time, there is no need to alter the basic arrangement of the head substrate and the configuration of the heat sink. In addition, the characteristic of the thermal printhead can be varied within a wider range by altering adhesive members attaching the head substrate and the heat sink.

In the above method, the thermal conductance of the heat-transfer adjusting region is lowered to improve the temperature detecting response of the temperature sensor. Alternatively, the thermal conductance of the heat-transfer adjusting region is improved to lower the temperature detecting response of the temperature sensor.

Further, in the above method, the adhesive member is rendered to have a high thermal conductivity to increase the heat dissipation from the heat sink. Alternatively, the adhesive member is rendered to have a low thermal conductivity to lower the heat dissipation form the heat sink.

Other features and advantages of the present invention will become clearer from the following detailed explanation with reference to the accompanying drawings.

BEST MODE FOR CARRYING OUT THE INVENTION

Figure 1:
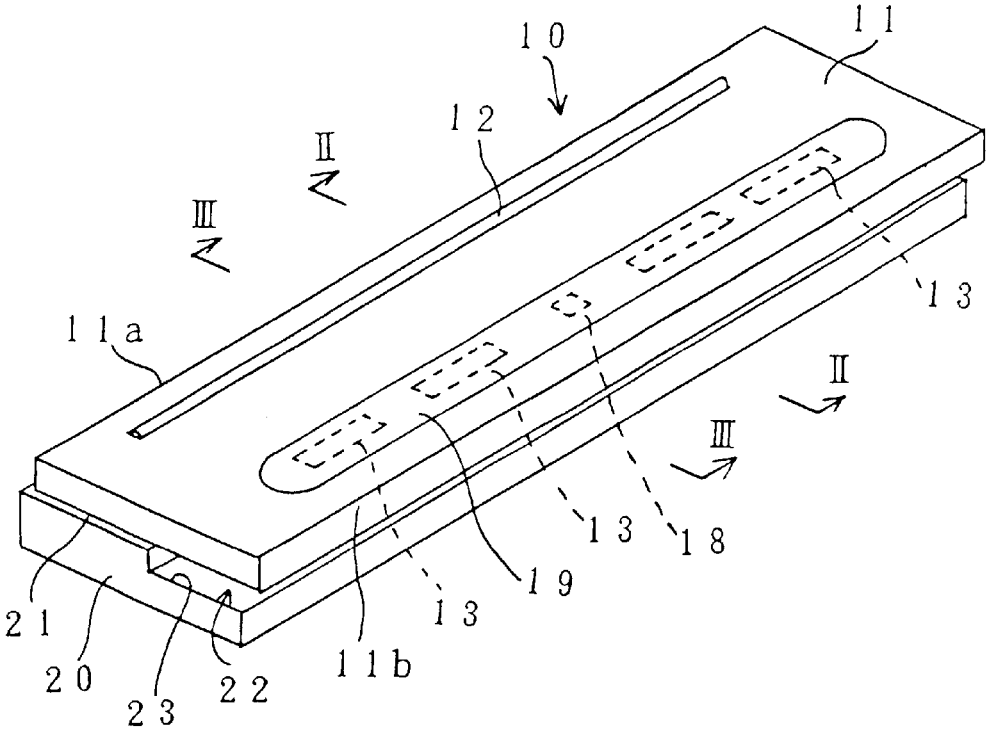
FIG. 1 is a perspective view showing an embodiment of a thermal printhead according to the present invention.
Figure 2:
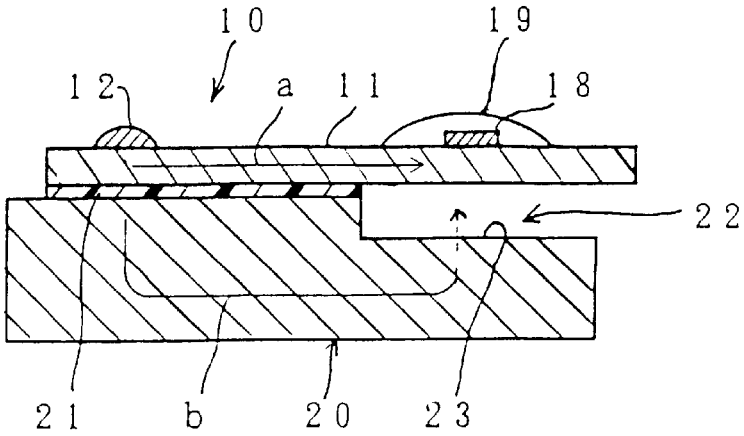
FIG. 2 is a sectional view along lines II—II in FIG. 1.
Figure 3:
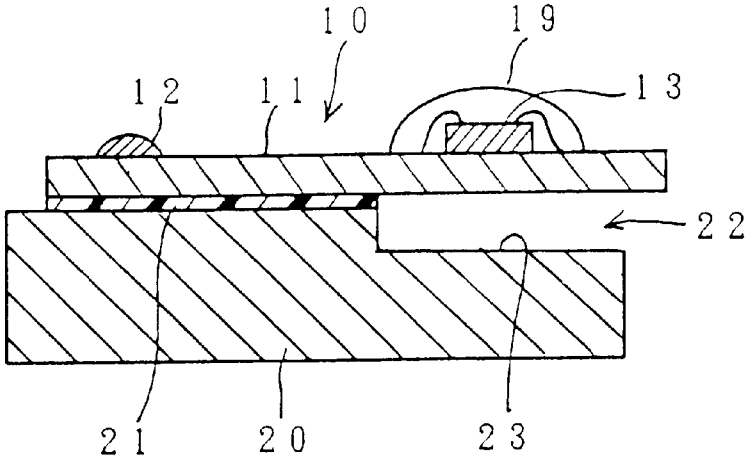
FIG. 3 is a sectional view along line III—III in FIG. 1.
Figure 4:
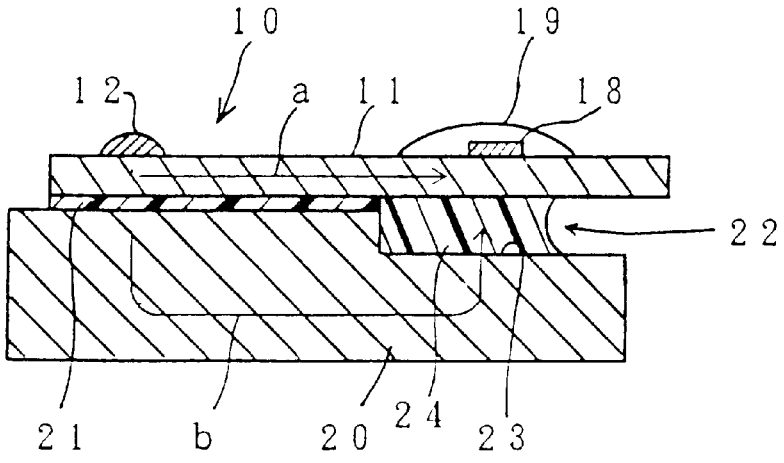
FIG. 4 is a view corresponding to the sectional view taken along lines II—II in FIG. 1.
Figure 5:
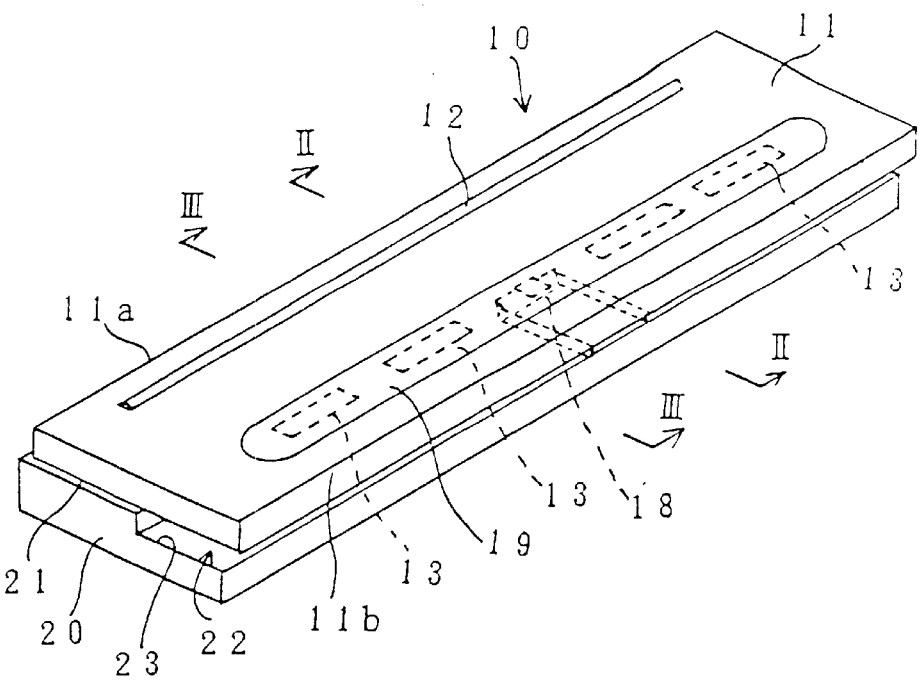
FIG. 5 illustrates a heat-transfer adjusting member which is provided only at a portion corresponding to the location of a temperature sensor.
Figure 6:
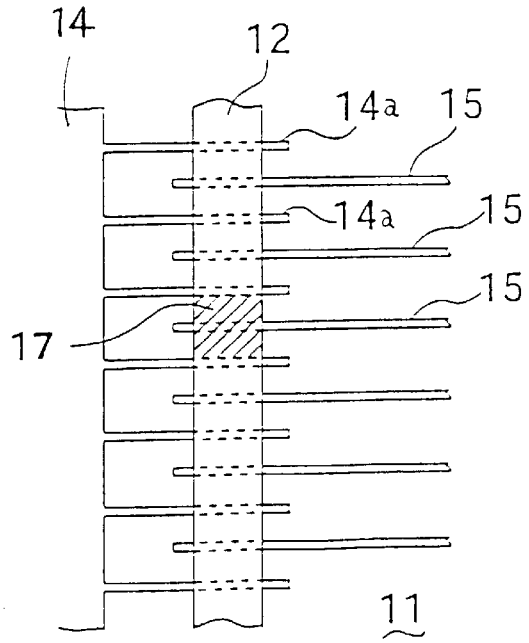
FIG. 6 is an enlarged plan view showing a heating portion in detail.

FIG. 1 is a perspective view showing an example of a thermal printhead 10 according to the present invention. FIGS. 2 and 4 are sectional views taken along lines II—II in FIG. 1. FIG. 3 is a sectional view taken along lines III—III in FIG. 1. FIG. 5 illustrates a heat-transfer adjusting member provided only at a portion corresponding in location to a temperature sensor. FIG. 6 is a detailed plan view showing a heating element. Throughout these figures, the same reference numerals are used for members or elements similar to those of the prior art shown in FIGS. 8–11.

The thermal printhead 10 has a basic structure of a typical thick film-type thermal printhead. A head substrate 11 is made of an insulating material such as alumina-ceramic for example and formed into an elongated rectangular plate. The upper surface of the substrate is provided with a heating element 12 and drive ICs 13 for driving the heating element 12. The heating element 12 is made of a resistive paste such as a ruthenium oxide paste and formed into a narrow strip extending along a first edge 11*a* of the substrate 11 by a thick film printing method. Further, as is seen in detail from FIG. 6, the upper surface of the head substrate 11 is formed with a common electrode 14 having comb-like teeth 14*a* extending under the heating element 12, and individual electrodes 15 also arranged like comb-like teeth. In the illustrated embodiment, respective regions defined by the comb-like teeth 14*a* of the common electrode 14 function as heating dots 17. When a selected individual electrode 15 is turned on by a drive IC 13 described below, an electric current passes through the shaded region shown in FIG. 6 for actuating the heating dot 17.

The respective individual electrodes 15 extend toward a second edge 11*b* of the head substrate 11 and are wire-bonded to corresponding output pads of the drive ICs 13 arranged along the second edge. Likewise, power pads and signal pads of the drive ICs 13 are wire-bonded to a predetermined wiring pattern formed on the head substrate 11.

FIGS. 1 and 5 present simplified views. Actually, however, 1728 heating dots 17 are arranged in series at a pitch of 125 $\mu$m, and 27 drive ICs 13 having 64 bits of output pads are mounted for producing a thermal printhead capable of performing an A4-size printing operation while attaining a printing density of 200 dpi for example.

Further, the head substrate 11 is provided with a thermistor 18 as a temperature sensor. The thermistor monitors the temperature variation of the heating element 12, thereby enabling an unillustrated controlling device (CPU) to control the width of the printing pulse. To this end, generally, the thermistor 18 is located at a longitudinally central portion of the head substrate and between two adjacent drive ICs 13.

The drive ICs 13 together with the bonding wires connecting the upper surface pads of the drive ICs to the wiring pattern are enclosed by a protective coating 19. The protective coating 19 is made of a thermosetting resin such as an epoxy resin. Specifically, the thermosetting resin in a liquid state is applied to enclose the drive ICs 13 and the bonding wires, and then heat-cured.

An adhesive member 21 is used to attach the head substrate 11 to the rectangular heat sink 20 which is made of a metal such as aluminum and remarkably dissipates heat.

The first feature of the present invention resides in that a heat-transfer adjusting region 22, corresponding in location to the temperature sensor (thermistor) 18 on the head substrate 11, is provided on the lower side of the head substrate 11 for adjustment of the heat transfer from the heat sink 20 to the thermistor 18 on the head substrate 11. In the illustrated embodiments of the present invention, the above region is provided by forming a cutout 23 in the heat sink 20.

The cutout 23 is occupied by a heat-transfer adjusting member 24 (see FIG. 4) or not occupied (see FIG. 2). The cutout 23 may be formed only at a longitudinally limited portion of the heat sink 20 or formed along the entire longitudinal length of the heat sink. In the latter case, the heat sink 20 longitudinally has a uniform cross section, and therefore is readily produced by extrusion. Various kinds of heat-transfer adjusting members 24 are selectively used for providing desired thermal conduction.

When it is desired to lower the thermal conductivity of the heat-transfer adjusting region 22 to reduce heat conduction from the heat sink 20 to the thermistor 18 for instance, the cutout 23 is not occupied, as shown in FIG. 2, so that thermal insulation is provided by the air. On the other hand, when it is desired to increase the thermal conductivity of the heat-transfer adjusting region 22 to increase heat conduction from the heat sink 20 to the thermistor 18, the cutout 23 is occupied by a heat-transfer adjusting member 24 having a remarkable thermal conductivity, as shown in FIG. 4. An example of such a remarkable heat-transfer adjusting member 24 is a silicone resin. The silicone resin arranged in the cutout 23 should be brought into contact with the lower surface of the head substrate 11, as shown in FIG. 4. It is obvious that various kinds of heat-transfer adjusting members may be utilized for providing desired thermal conductivity.

The thermistor 18 is mounted for monitoring the temperature variation of the heating element 12 for the purpose of controlling the width of the printing pulse, as previously described. The heat generated by the heating element is conducted to the thermistor 18, via the head substrate 11 as shown by an arrow a in FIG. 2 and via the heat sink 20 as shown by an arrow b in FIG. 2. The heat conducted through the head substrate 11, which is made of a thin plate of alumina-ceramic, quickly reaches the thermistor 18, whereas the heat conducted through the heat sink 20, which has relatively great thickness and thermal capacity, reaches the thermistor 18 with timewise descrepancy. When the thermistor 18 detects a combination of the heats conducted via the paths a and b, it does not reflect the temperature variation of the heating element 12 itself. However, when the heat via the path a is mainly detected, it is possible to detect a temperature variation which more accurately reflects the temperature variation of the heating element 12. When the heat-transfer adjusting region 22 is occupied by an adjusting member having a high thermal conductivity, the heats conducted via the two paths a and b reach the thermistor 18. On the other hand, when the heat-transfer adjusting region 22 is insulated by the air, the thermistor 18 mainly receives the heat conducted via the path a. In this way, the provision of the heat-transfer adjusting region 22 facilitates the adjusting of the detecting response of the thermistor 18 for the temperature variation of the heating element 12. Besides, there is no need to alter the basic construction of the head substrate 11.

The second feature of the present invention resides in that the heat dissipation from the heat sink 20 is substantially adjusted by using an adhesive member 21 having a selected thermal conductivity in attaching the head substrate 11 to the heat sink 20. With the use of the adhesive member 21 having a high thermal conductivity, a greater amount of heat is conducted from the heating element 12 to the heat sink 20 via the adhesive member 21. As a result, heat dissipation from the heat sink 20 is substantially increased. On the other hand, with the use of the adhesive member 21 having a low thermal conductivity a less amount of heat is conducted from the heating element 12 to the heat sink 20 via the adhesive member 21. As a result, heat dissipation from the heat sink 20 is substantially decreased. Examples of adhesive member having a lower thermal conductivity are epoxy resin adhesives and acrylic resin adhesives. For increasing the thermal conductivity of these adhesives, a predetermined amount of particles of a material having a higher thermal conductivity than the adhesives is added. Examples of such an additive are particles of silicone, alumina-ceramic, metal such as copper and the like. An example of an adhesive having a high thermal conductivity is a silicone resin adhesive.

Figure 7:
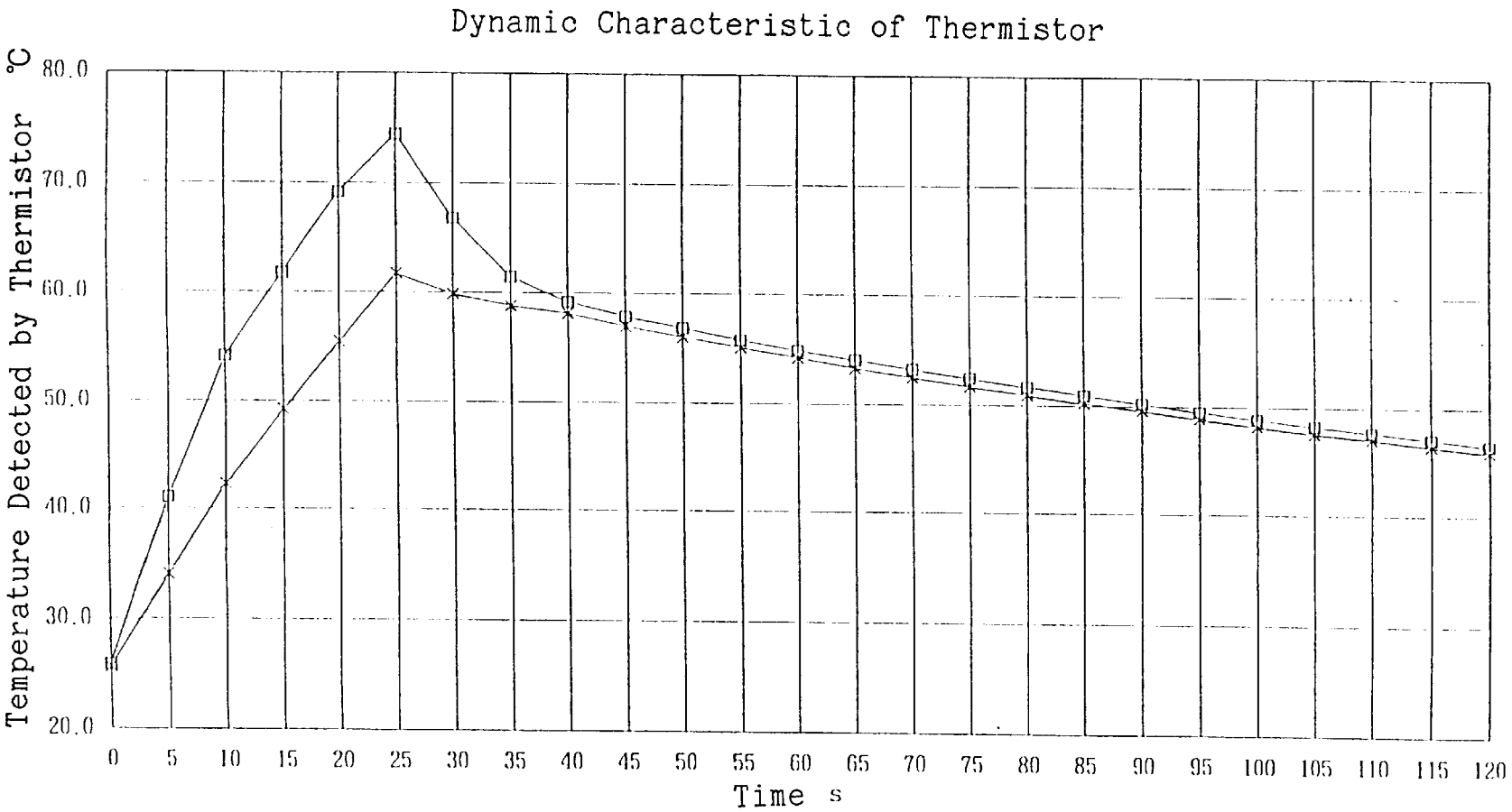
FIG. 7 is a graph illustrating function.
Figure 8:
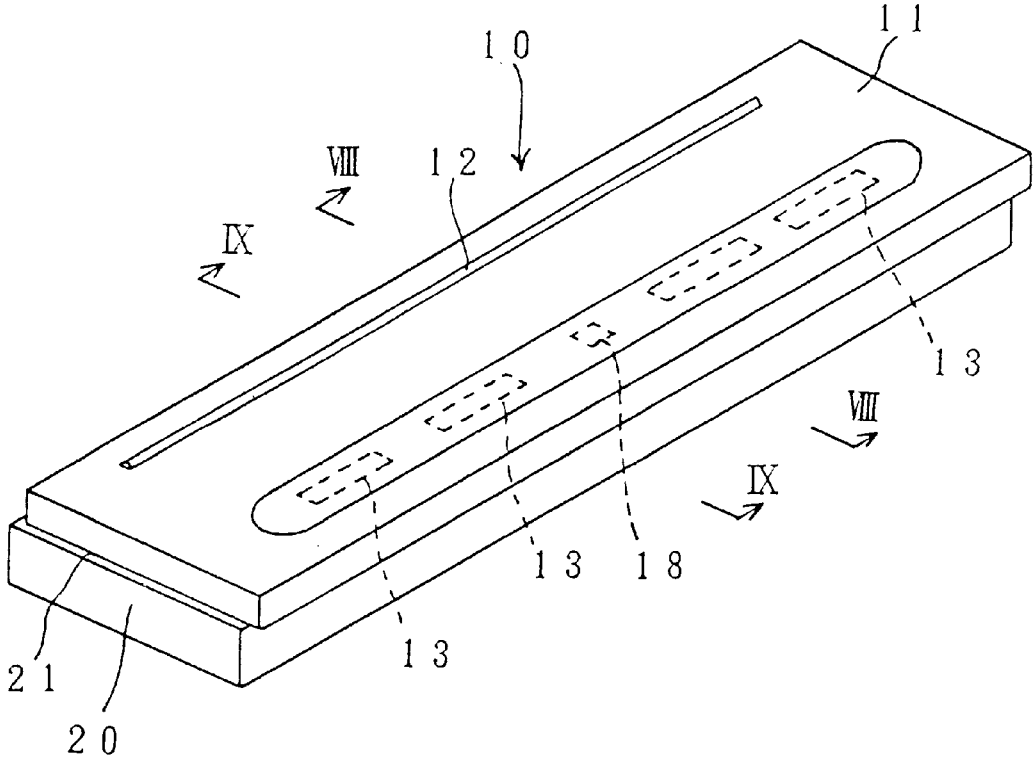
FIG. 8 is a perspective view showing a prior art thermal printhead.
Figure 9:
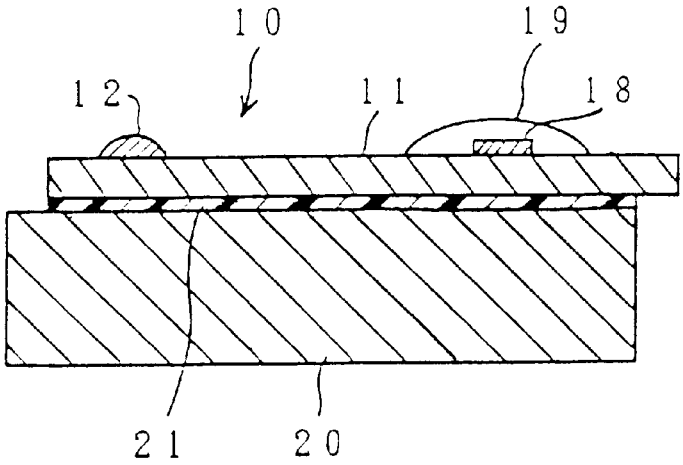
FIG. 9 is a sectional view taken along lines VIII—VIII in FIG. 8.
Figure 10:
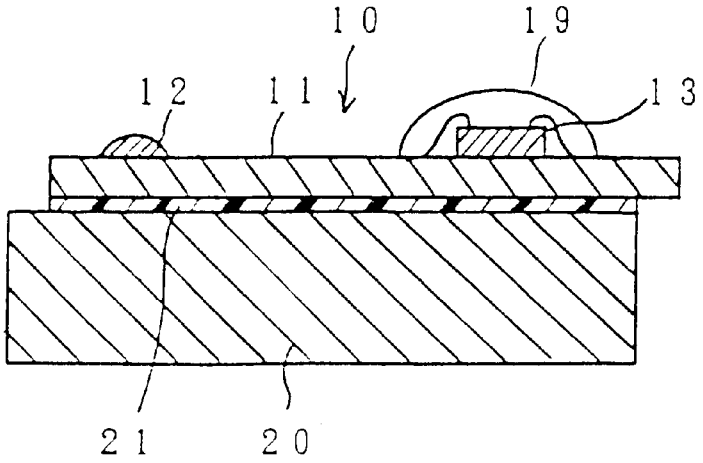
FIG. 10 is a sectional view taken along lines IX—IX in FIG. 8.
Figure 11:
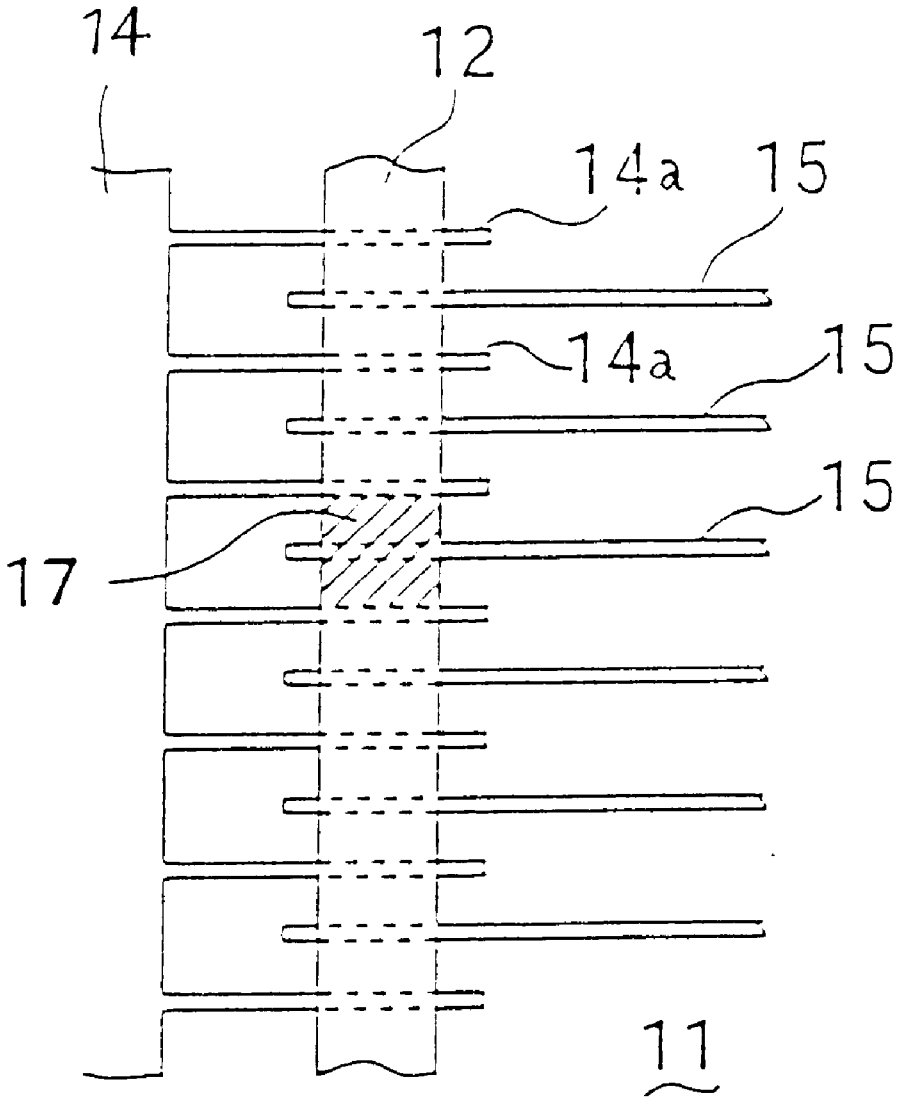
FIG. 11 is an enlarged plan view showing a heating portion in detail.

FIG. 7 illustrates the advantage of the second feature of the present invention. The figure shows the dynamic characteristics of the thermistor 18 wherein electric power was supplied at room temperature for 25 seconds to perform a solid printing operation. In this measurement, the printing period was 10 ms, and the individual driving time for heating was 1.95 ms. In the figure, the sign □ indicates a comparative example wherein an acrylic resin adhesive was used as the adhesive member, while the sign x indicates an instance wherein a silicone adhesive of the present invention was used as the adhesive member. As is seen from the figure, it took only 15 seconds for the comparative example to reach a temperature of 62° C., while it took 25 seconds for the present invention. This means that the heat dissipation from the heat sink 20 was increased.

In the comparative example, the detected temperature sharply increased. Thus, a CPU capable of processing at a high speed is needed to properly control the width of the printing pulse. However, according to the present invention, the detected temperature increases in a relatively gentle manner. Thus, there is no need to use a CPU capable of performing processing at such a high speed to control the width of the printing pulse. In practice, for performing a high-speed printing, a predetermined printing energy should be applied with the printing period shortened. As a result, the temperature tends to rise more sharply. However, if this is detected as it is, the processing speed of the CPU may not be fast enough for it. However, according to the present invention, the temperature detected by the thermistor 18 is rendered to rise gently. Thus, a conventionally available CPU can be used for the processing.

When the thermal conduction of the heat-transfer adjusting region 22 is increased, a greater amount of heat reaches the thermistor 18 via the heat sink 20. As a result, regarding the temperature variation illustrated in FIG. 7, the peak at 25 seconds is lowered and shifted backward therefrom to provide a new characteristic curve. This is due to the influence of the heat which is conducted through the heat sink 20 and reaches the thermistor 18 after a delay.

It is apparent that the scope of the present invention is not limited to the embodiments described above. For instance, the heating element of the thermal printhead may be formed into a thin-type. In the illustrated embodiments, the heat-transfer adjusting region 22 is formed by providing the heat sink 20 with a cutout 23. However, the configuration of the cutout may be varied. Further, there are various ways to determine the thermal conductance of the adhesive member attaching the head substrate and the heat sink. For example, it is possible to vary the thickness of an adhesive tape. In this instance, a desired number of pieces of the adhesive tape are provided between the head substrate and the heat sink. Further, the total area of the adhesive member may be varied. For this, the adhesive tape may be made in a dot-like form and the density of dots arranged between the head substrate and the heat sink may be varied.

Conventionally, an acrylic or epoxy resin adhesive is used to attach the head substrate to the heat sink of a typical thermal printhead of the above type. However, it is possible to use other adhesive members having an increased thermal conductivity. For example, the head substrate and the heat sink may be attached together by a novel adhesive member which includes an acrylic or epoxy resin adhesive as a base and contains particles of silicon, ceramic or other metals. Further, a silicone resin adhesive may be used as the adhesive member. These things, as long as the requirements for the heat-transfer adjusting region on the lower side of the thermistor are satisfied, should be regarded as being involved within the scope of the present invention.

We claim:

1. A thermal printhead comprising a head substrate made of an insulating material, a heating element arranged along an edge of the substrate, drive ICs for driving the heating element, a temperature sensor mounted on the head substrate for temperature monitoring of the heating element, and a heat sink attached to the head substrate, wherein the heat sink has a first surface for attachment to the head substrate, the head substrate having a projecting portion projecting beyond the first surface of the heat sink, the heat sink also having a second surface spaced from the projecting portion of the head substrate in facing relation thereto for defining a heat-transfer adjusting region, the temperature sensor being mounted on the projecting portion of the head substrate, and wherein the head substrate is attached to the first surface of the heat sink by an adhesive member having a desired heat conductivity.

2. The thermal printhead according to claim 1, wherein the heat-transfer adjusting region is provided with a heat-transfer adjusting member.

3. The thermal printhead according to claim 2, wherein the heat-transfer adjusting region is entirely occupied by the heat-transfer adjusting member.

4. The thermal printhead according to claim 2, wherein the heat-transfer adjusting member is provided only at a portion corresponding to the location of the temperature sensor on the head substrate.

5. The thermal printhead according to any one of claim 1, wherein the heat-transfer adjusting region is formed by providing the heat sink with a cutout.

6. The thermal printhead according to any one of claim 1, wherein the adhesive member comprises an acrylic or epoxy resin adhesive containing particles of a material having a higher heat conductivity.

7. The thermal printhead according to any one of claims 1–5, wherein the adhesive member comprises a silicone resin adhesive.

8. A thermal printhead comprising a head substrate made of an insulating material, a heating element arranged along an edge of the substrate, drive ICs for driving the heating element, a temperature sensor mounted on the head substrate for temperature monitoring of the heating element, and a heat sink attached to the head substrate, wherein the heat sink has a first surface for attachment to the head substrate, the head substrate having a projecting portion projecting beyond the first surface of the heat sink, the heat sink also having a second surface spaced from the projecting portion of the head substrate in facing relation thereto for defining a heat-transfer adjusting region, the temperature sensor and the drive ICs being mounted on the projecting portion of the head substrate, and wherein the head substrate is attached to the first surface of the heat sink by an adhesive member having a desired heat conductivity.

9. The thermal printhead according to claim 8, wherein the heat-transfer adjusting region is provided with a heat-transfer adjusting member.

10. The thermal printhead according to claim 9, wherein the heat-transfer adjusting region is entirely occupied by the heat-transfer adjusting member.

11. The thermal printhead according to claim 9, wherein the heat-transfer adjusting member is provided only at a portion of the heat-transfer adjusting region corresponding to the location of the temperature sensor on the head substrate.

12. The thermal printhead according to claim 8, wherein the heat-transfer adjusting region is formed by providing the heat sink with a cutout portion.

13. The thermal printhead according to claim 8, wherein the adhesive member comprises an acrylic or epoxy resin adhesive containing particles of a material having a higher heat conductivity.

14. The thermal printhead according to claim 8, wherein the adhesive member comprises a silicone resin adhesive.

* * * * *